United States Patent [19]

Pollock

[11] Patent Number: 4,736,955

[45] Date of Patent: Apr. 12, 1988

[54] PITCH AND TOSS GAME

[76] Inventor: David G. Pollock, 1557 O'Connor (McDade Estates), Conroe, Tex. 77304

[21] Appl. No.: 844,320

[22] Filed: Mar. 26, 1986

[51] Int. Cl.[4] ..... A63B 67/06

[52] U.S. Cl. ..... 273/336; 273/346; 273/DIG. 24; 273/DIG. 30

[58] Field of Search ..... 273/336, 346, DIG. 30, 273/DIG. 24, 338, 413, 408

[56] References Cited

U.S. PATENT DOCUMENTS

| | | | |
|---|---|---|---|
| 289,032 | 11/1883 | Sears | 273/408 |
| 626,328 | 6/1899 | Kroscher et al. | 273/338 |
| 1,513,968 | 11/1924 | Crandall | 273/336 |
| 1,899,820 | 2/1933 | Milne | 273/336 |
| 2,050,914 | 8/1936 | Anderson | 273/102 |
| 2,432,824 | 12/1947 | Shetler | 273/336 X |
| 2,568,279 | 9/1951 | Franz et al. | 273/DIG. 24 X |
| 3,628,793 | 12/1971 | Mudloff | 273/105 |
| 3,709,495 | 1/1973 | Krombein | 273/DIG. 24 X |
| 3,790,171 | 2/1974 | Anderson | 273/413 |
| 3,997,162 | 12/1976 | Scullin | 273/346 X |
| 4,012,042 | 3/1977 | Blasingame | 273/95 |
| 4,017,076 | 4/1977 | Bai | 273/102 |
| 4,133,526 | 1/1979 | Anson | 273/1 |
| 4,203,592 | 5/1980 | Quatkemeyer | 273/336 |
| 4,204,682 | 5/1980 | Brown | 273/401 |
| 4,243,229 | 1/1981 | Huser et al. | 273/402 |
| 4,440,399 | 4/1984 | Smith | 273/346 |
| 4,447,060 | 5/1984 | Guinn | 273/346 |
| 4,460,179 | 7/1984 | Hafer | 273/402 |

*Primary Examiner*—William H. Grieb

*Attorney, Agent, or Firm*—Marsteller & Associates

[57] ABSTRACT

A pitch and toss game apparatus comprising a first target (10) and a plurality of throwing objects (17). The first target (10) is constructed with a centrally located cylindrical cavity (11). The upper surface (10*u*) of the first target (10) has a layer of a first contact engaging material (12) attached to it. The throwing objects (17) are covered with a second contact engaging material (18), complementary to the material covering the upper surface (10*u*) of the first target (10). When the throwing object (17) is pitched or tossed towards the first target (10), the first contact engaging material (12) of the first target (10) and the second contact engaging material (18) of the throwing object (17) cause the throwing object (17) to firmly stick to the first target (10) at or near the point of initial contact should the throwing object (17) miss landing in the centrally located cylindrical opening (11). A pole shaped member (20) may be later fitted inside the centrally located cylindrical cavity (11) to transform the primary pitch and toss game apparatus into a ring/horseshoe style pitch and toss game. A second target (28) having its top surface (29) covered with a first contact engaging material (12) and the lower surface of the second target (28) covered with a second contact engaging material (18) may later be affixed to the first target (10) to transform the primary pitch and toss game into a "tic-tac-toe" style pitch and toss game.

3 Claims, 2 Drawing Sheets

PITCH AND TOSS GAME

BACKGROUND OF THE INVENTION

1. Field of the Invention.

This invention relates to a pitch and toss game in which throwing objects are pitched at a distance towards a target and points are scored in accordance with the relationship of the throwing object to the target after the thrown object has landed.

2. Description of Related Art.

Games requiring skill in the tossing of an throwing object towards a target are well-known in the art. One such pitch and toss game is disclosed in U.S. Pat. No. 3,628,793 issued to Mudloff on Dec. 21, 1971. Mudloff discloses a bean-bag type of tossing and point-scoring game. Each bag trapping target provides an inclined surface and has a centralized bag-receiving hole. Points are scored when the thrown or tossed bean-bag either passes through the centralized bag-receiving hole or lands and stays upon the inclined surface.

U.S. Pat. No. 4,243,229, issued to Huber et al on Jan. 6, 1981, discloses a pitch and toss game with a plurality of circular disks and a target comprising an upright backboard and an inclined playing board with a circular opening. The disks are tossed and come to rest on the top surface of the playing board or fall through the opening. Points are scored in relation to the distance of the final resting place of the thrown disks to the circular opening.

The above-referenced patents fail to consider one important problem of pitch and toss games—the tendency of the thrown object to bounce and skip upon striking the target or the nearby ground. A poor throw, which would have been a low or no point toss, can be converted to a high scoring toss courtesy of a "lucky bounce." On the other hand, an excellent throw, deserving of a high score, can become transformed by an "unlucky bounce" into an undeserved low point score. Thus what is intended to be a game of skill too often is decided by a chance bounce of the thrown object and the skill level required to triumph in such a game is greatly reduced. Thus, there has been a long-felt need for a pitch and toss game which more accurately reflects the skill of the participants alone and reduces the affect of lucky bounces upon such a game. This invention reduces the affect of lucky bounces upon pitch and toss games by disclosing a throwing object and target of such weight, shape and construction, that when the throwing object is tossed, it will firmly stick to the target at the point of initial contact.

With the advent of contact engaging type materials such as "Velcro" manufactured by the Velcro Corporation of New York, N.Y., becoming commercially available, the use of such contact engaging materials to allow throwing object/target adherence upon initial target contact has become popular. U.S. Pat. No. 4,447,060, issued to Guinn on May 8, 1984, discloses a donut shaped projectile having hook material on one side of the projectile and complementary loop material on the other side for use in a target game. However, the projectile disclosed in Guinn is undesirable for use in pitch and toss games since should the wrong side of the projectile contact the target, the projectile would slip and not stick to the target.

Furthermore, the tendency of the thrown projectiles described in Guinn to stick upon one another is undesirable in a pitch and toss games. Thus, while throwing objects which adhere to their target upon initial throwing object/target contact have become common, there has yet to be a successful adaptation of this technology to the unique requirements necessary to maintain the integrity of the traditional pitch and toss games.

Another problem with the traditional pitch and toss games is that the game often becomes tiresome and not interesting after a short period of play, particularly with children with short attention spans. One solution to this problem would be to design a pitch and toss game which can be quickly and easily modified to permit users of the game to play other pitch and toss games. Other pitch and toss games which require different skills and strategies in playing would maintain playing interest longer than a pitch and toss game limited to one specific form of game.

SUMMARY OF THE INVENTION

The pitch and toss game which is the subject of this invention includes a cylindrically shaped first target with a centrally located cylindrical opening, said first target being placed upon the playing surface, and a plurality of throwing objects which are pitched or tossed from a distance agreed upon by the participants at the cylindrically shaped first target. The upper surface of the first target is covered with a layer of a first contact engaging material. Similarly, the throwing objects are completely covered with a second contact engaging material, complementary to the first contact engaging material. The throwing objects are pitched or tossed by the participants towards the first target. The first contact engaging material on the first target and the second contact engaging material on the throwing objects cause the throwing objects not landing in the centrally located cylindrical opening to firmly stick to the first target at the point of initial contact. Points scored by participants are determined in relation to the number of throwing objects landing in the centrally located cylindrical opening and the location of the remaining throwing objects on the first target after the throwing objects have struck the first target.

In addition to the primary pitch and toss game which can be played by the participants, the game apparatus can be quickly and easily modified to permit users to play other pitch and toss games requiring different strategies and throwing skills. One such alternate pitch and toss game involves the use of a pole shaped member with a much wider attached base of slightly less width and the equivalent height of the centrally located cylindrical opening can be snugly fit inside the centrally located cylindrical opening of the first target to create a ring/horseshoe pitch and toss game that can be played with either rings or horseshoes. Another variation of the primary pitch and toss game involves the affixation of a second target, thus converting the primary pitch and toss game to a "tic-tac-toe" style pitch and toss game. The conversion is accomplished by affixing the second target, said second target having a top surface covered with contact engaging material and a lower surface covered with complementary contact engaging material, to the first target and thereby covering the cylindrical opening and the markings of the upper surface of the first target, the second target having a second set of markings which correspond to the design of a "tic-tac-toe" board.

It is an object of this invention to provide a pitch and toss game where the tossed throwing objects will stick firmly, instead of bouncing or skipping, at the location of initial contact with the target, thus creating a pitch and toss game which will score each toss accurately and which will focus upon the skill of the participants and eliminates the luck factor caused by the throwing objects bouncing upon striking near or on the target with the result that the toss is scored differently than it should be.

It is a further object of this invention to utilize present throwing objects sticking technologies and adapt them for use in a pitch and toss games while keeping the integrity of the pitch and toss game strategy intact.

Still another object of this invention to provide a pitch and toss game which is readily adaptable to numerous and distinctly different pitch and toss games, each requiring different throwing skills and strategies, thus increasing the period of time which the pitch and toss game remains interesting.

Yet another object of this invention is to provide a pitch and toss game which is designed to be easily stored by permitting the stacking of the targets upon each other and easily transported by maintaining a relatively low target weight.

DESCRIPTION OF THE PREFERRED EMBODIMENT(s)

Figure 1:
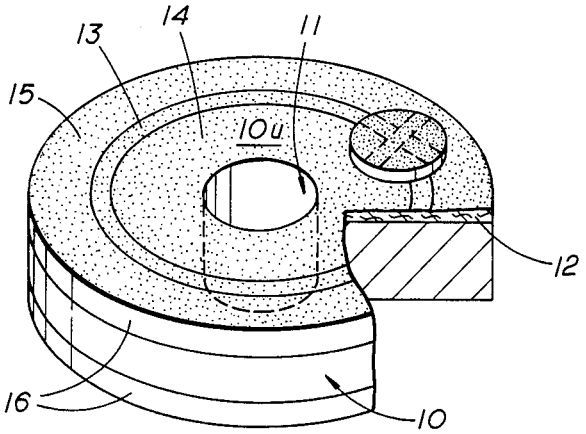
FIG. 1 is a sectional view of the first target used in the pitch and toss style game.

Referring to FIG. 1, there is shown a sectional view of the first target 10 for use in Applicant's pitch and toss game. Each first target should be constructed of sturdy, lightweight material, but should have sufficient weight and enjoy a low center of gravity so that the first target 10 will resist movement when struck by thrown objects. Each first target would be preferably constructed in a cylindrical shape with the diameter of the first target exceeding the height. Each first target 10 includes a cylindrical cavity 11 located in the center of the upper surface 10*u* of the first target 10, although any opening in the upper surface 10*u* of the first target 10 will be satisfactory. A first target having a diameter of 16 to 18 inches with a cylindrical cavity having a diameter of 3 inches has been found by the applicant to work quite well for this purpose. The upper surface 10*u* of the first target 10 is provided with a layer of a first contact engaging material 12 firmly attached to the first target 10. Such contact engaging material 12 may be the "hook" surface of a "Velcro" hook and loop material. The upper surface 10*u* of the first target 10 is divided by a marker 13 which partitions the first target 10 into a high scoring zone 14 and a low scoring zone 15. Desirably, luminescent material 16 is attached to the first target 10 in order to increase visibility of the first target 10 at night.

Figure 2:
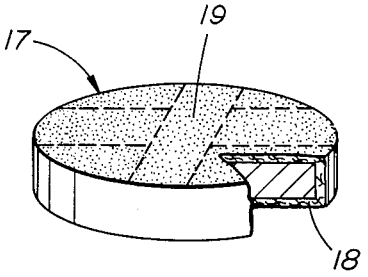
FIG. 2 is a sectional view of the throwing object used in the pitch and toss style game.

Referring to FIG. 2, there is shown a sectional view of the throwing object 17 for use in the Applicant's pitch and toss game. The throwing object 17, which may be constructed from a steel alloy, must have a diameter less than the cylindrical cavity 11 and would preferably be disk shaped. The throwing object 17 is completely covered with a layer of a second contact engaging material 18, complementary to the material covering the upper surface 10*u* of the first target 10, attached to the throwing object 17. An example of such complementary material is "Velcro" loop material. Markings 19, preferably of the luminescent type, are used to distinguish between the throwing objects of the opposing players and to increase the visibility of the game at night.

Figure 7:
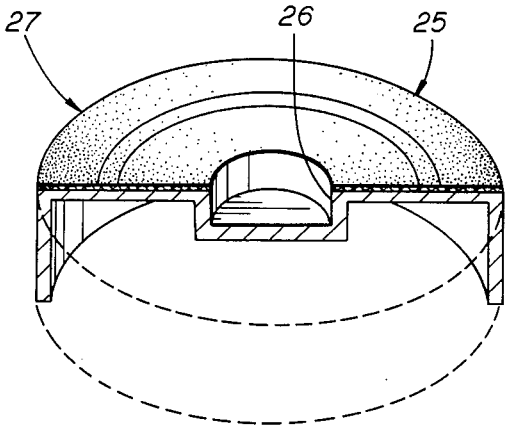
FIG. 7 is a sectional view of an alternative embodiment of the first target used in the pitch and toss style game.

Referring to FIG. 7, there is shown an alternative embodiment of the design and construction of first target 10. Here, the first target 25 is of an inverted saucer shape with thin walls and a hollow interior so that the first target will enjoy a relatively light weight for ease in transportation. The light weight will further facilitate storage of the first targets 25 by encouraging the stacking of several of the first targets 25 upon each other. FIG. 7 further shows an alternate embodiment of the cylindrical cavity 11 of FIG. 1. Here, a round hole 26 with a diameter of equal dimension to the cylindrical cavity 11 of first target 10 exists in the upper surface 27 of the first target 25, such hole the applicant has found to work quite well.

It should be further noted here that while the inventor has disclosed two different embodiments of the first target, it is contemplated by the inventor that the features of the alternate embodiments are readily interchangeable with each other, thus effectively disclosing several additional embodiments of the first target.

OPERATION

Figure 3:
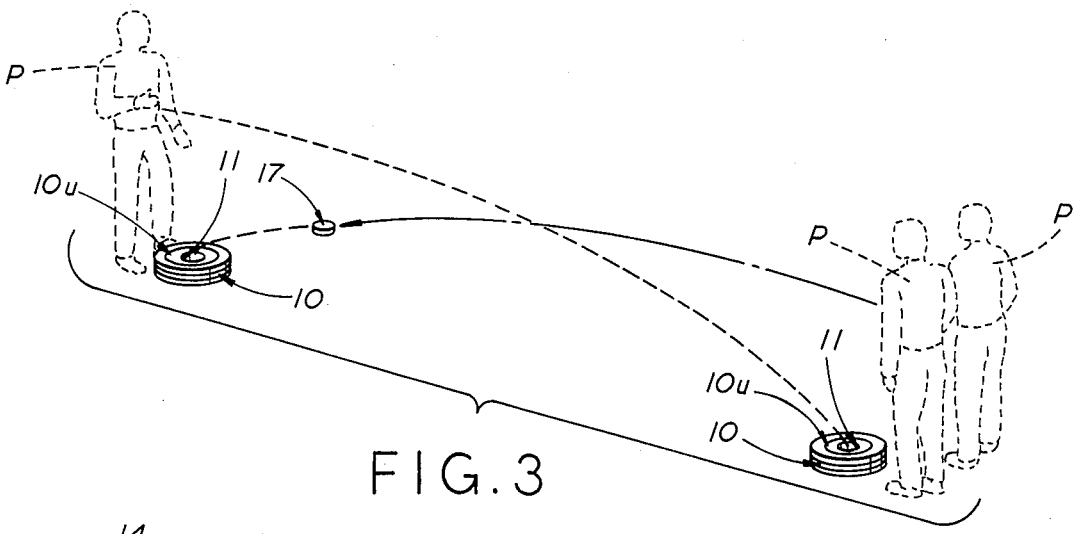
FIG. 3 is a side representational view depicting the play of the pitch and toss style game.

The method of playing Applicant's pitch and toss game is best illustrated with reference to the side representational view depicting the play of the pitch and toss style game shown in FIG. 3. The first targets 10 are laid on a playing field separated by a distance designated by the participants P. It is preferred that the upper surface 10*u* be horizontal or nearly horizontal. While any separation between the first targets may be chosen by the participants, a separation of 21 feet has been found to work quite well. Each participant stands behind a selected first target 10 and tosses an equal number of throwing objects 17 towards the oppositely located first target 10. Each throwing object 17 tossed by the participants P will travel in an arc-shaped trajectory and strike the first target 10 on its downward path. The optimal goal of each participant is to toss each throwing object 17 allotted to him into the centrally located cylindrical cavity 11. The secondary goal of each participant is to toss each throwing object 17 as near as possible to the cylindrical cavity 11, preferably striking the first target 10 in the process. If a participant fails to toss a throwing object 17 into the cylindrical cavity 11, but succeeds in tossing the throwing object 17 onto the upper surface 10*u* of the first target 10, the second contact engaging material 18 of the throwing object 17 will affix to the contact engaging material 12 of the first target 10, causing the throwing object 17 not landing in the cylindrical cavity 11 to firmly stick to the first target 10 at or near the point of initial contact as shown in FIG. 1. If a second throwing object is thrown and lands on a throwing object that is affixed to the first target, the second throwing object would bounce off the affixed throwing object since both throwing objects are covered with similar contact engaging material.

While the pitch and toss game may be properly played by two participants opposing each other in play, the pitch and toss game is also readily adaptable to play by 3, 4 or any other number of participants by the creation of one or more teams of participants who alternatively toss throwing objects 17 towards the first target 10 for their team in accordance to a preselected order.

In one of an innumerable number of scoring methods that may be selected by the participants, points are awarded only to the participant who successfully tosses the greatest number of his alloted throwing objects 17 into the cylindrical cavity 11. In the event that neither participant was able to toss a throwing object 17 into the cylindrical cavity 11, points shall be awarded to the participant who tossed a throwing object 17 closest to the cylindrical cavity 11. The participant who receives points shall receive points according to the following scoring criteria:

(a) 3 points for every throwing object 17 tossed by the scoring participant into the cylindrical cavity 11 in excess of the number of throwing objects 17 tossed into the cylindrical cavity 11 by the non-scoring participant; (b) 2 points for each throwing object 17 tossed by the scoring participant into the high scoring zone; (c) 1 point for each throwing object 17 tossed by the scoring participant into the low scoring zone; (d) 2 points for each throwing object 17 tossed by the scoring participant that lays partially on the first target 10 and partially off the first target 10; (e) 0 points for each throwing object 17 tossed by the scoring participant that misses the first target 10 completely.

Play continues until a participant or team scores 21 points or any other predetermined winning score.

An alternative embodiment would mount the first target 10 on a surface such as a vertical wall and would have any throwing object 17 not sticking or affixing to the first target 10 fall to the floor or ground.

Figure 4:
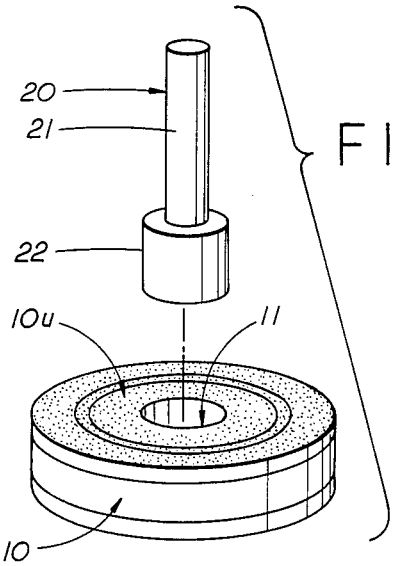
FIG. 4 is a exploded view of the first target when in use as a ring/horseshoe pitch and toss style game.

In yet another embodiment of the invention which discloses an alternate pitch and toss game is best illustrated with reference to the exploded view of the first target when in use in a ring/horseshoe pitch and toss style game shown in FIG. 4. A pole shaped member 20, comprised of a elongated pole 21 attached to a cylindrical base 22 of height equivalent to the cylindrical cavity 11 and width slightly less than the cylindrical cavity 11, is fitted snugly into the first target 10. The result of placing the pole shaped member 20 within the cylindrical cavity 11 is the transformation of the pitch and toss game from a game having a primary purpose of tossing throwing objects into the central cavity of a first target to a ring/horseshoe pitch and toss game having a primary purpose of tossing the throwing objects over the pole shaped member and scoring what is generally known as a "ringer".

Figure 5:
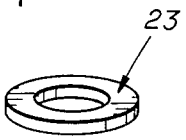
FIG. 5 is a perspective view of the throwing object used in the ring/horseshoe pitch and toss style game.

Referring to FIG. 5, there is shown a perspective view of the throwing object 23 for use in the Applicant's pitch and toss ring/horseshoe style game. Use of the throwing object 23 would permit the participant to enjoy a ring-toss style game. Rules of play may be selected in accordance with any of the traditional ring toss games.

Figure 6:
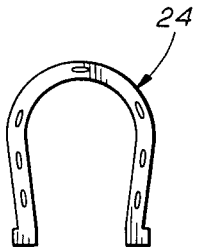
FIG. 6 is a perspective view of an alternative throwing object which may be used in the ring/horseshoe pitch and toss style game.

Referring to FIG. 6, there is shown a perspective view of an alternative throwing object 24 which may be used in the ring/horseshoe toss style game. Use of the throwing object 24 would permit the participant to enjoy a horseshoe style game. Rules of play may be selected in accordance with any of the traditional horseshoe type games.

Figure 9:
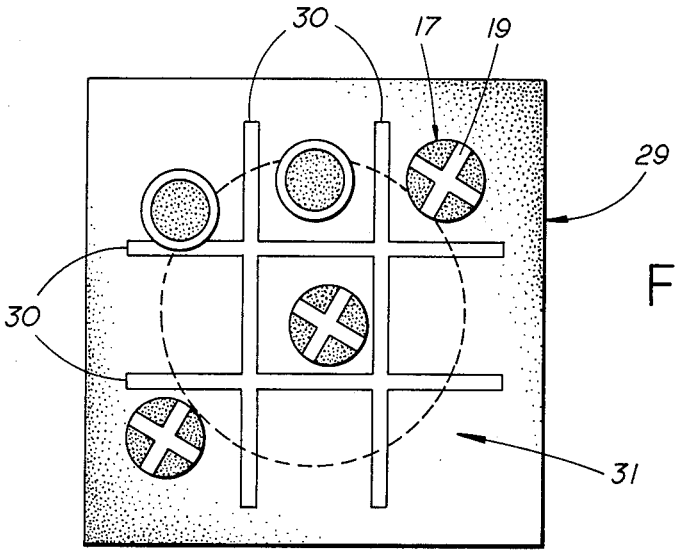
FIG. 9 is a exploded view of the first and second targets when the primary pitch and toss game is converted to a tic-tac-toe pitch and toss style game.

Still another alternative embodiment of the invention which discloses another alternate pitch and toss game is best illustrated with reference to the exploded view of the first and second targets shown in FIG. 9. The second target 28, preferably of a diameter equal to or greater than the diameter of first target 10, is provided with a top surface 29 comprised of a first contact engaging material 12 identical to the first contact engaging material 12 of first target 10. The lower surface of the second target 28 is covered with second contact engaging material 18 identical to the second contact engaging material 18 which covers the throwing object 17.

The second target 28 may be attached to the first target 10 by placing the second target 28 on top of the first target 10 where the second contact engaging material 18 of the second target 28 will adhere to the first contact engaging material 12 of the first target 10, thus effectively covering the cylindrical cavity 11 and markings 13 of first target 10.

Figure 8:
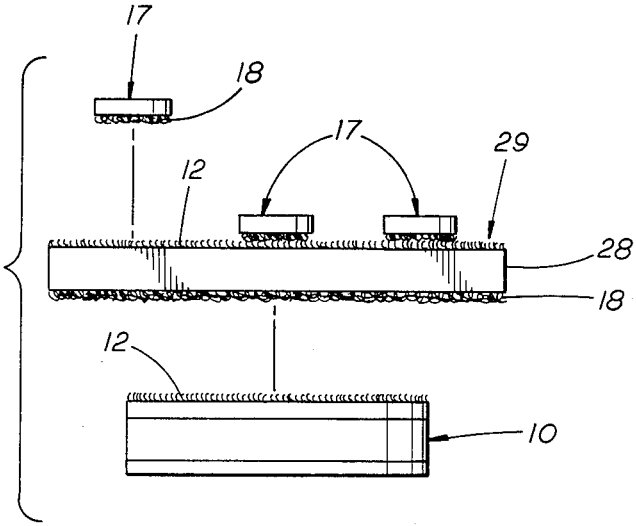
FIG. 8 is a top view of the top surface of the second target.

Referring to FIG. 8, the top view of the top surface 29 of the second target 28 is shown. The top surface is provided with markings 30 of similar composition to the markings 13 of the first target 10. The markings 30 are comprised of two sets of parallel lines which intersect at a right angle to divide the top surface 29 into 9 sections and thus create a "tic-tac-toe" shaped design. In this manner, the pitch and toss game may be transformed from a game having a primary purpose of tossing throwing objects 17 into the central cavity of a first target to a "tic-tac-toe" style pitch and toss style game having a primary purpose of tossing the throwing objects 17 into one of the nine sections 31 of the top surface 29 of second target 25 in accordance with the very well known rules of the game commonly known as "tic-tac-toe."

The foregoing disclosure and description of the invention are illustrative and explanatory thereof, and various changes in the size, shape and materials, as well as in the details of the illustrated construction may be made without departing from the spirit of the invention.

I claim:

1. A pitch and toss game apparatus comprising:

(a) a first target having a first contact engaging material covering the upper surface of said first target and including an opening in said upper surface;

(b) a second target having a second contact engaging material complementary to said first contact engaging material covering the lower surface of said second target and said first contact engaging material covering the top surface of said second target;

(c) at least one throwing object completely covered by said second contact engaging material;

wherein said second target may be affixed to the upper surface of the first target such that said throwing objects not missing said second target completely become firmly affixed to said second target upon initial contact and further any two of said throwing objects would not stick to each other.

2. The pitch and toss game of claim 1 wherein said second target includes a means for partitioning said top surface of said second target into at least two different zones.

3. The pitch and toss game apparatus of claim 2 wherein said first target, said second target and said throwing objects are marked luminescently.

* * * * *